US006998793B2

(12) United States Patent
Sheng

(10) Patent No.: US 6,998,793 B2
(45) **Date of Patent: *Feb. 14, 2006**

(54) INVERTER FOR PROVIDING POWER TO LAMP CIRCUIT

(75) Inventor: Kung-Cho Sheng, Taipei Hsien (TW)

(73) Assignee: Primax Electronics Ltd., Taipei (TW)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 80 days.

(21) Appl. No.: 10/604,897

(22) Filed: Aug. 26, 2003

(65) Prior Publication Data

US 2005/0007800 A1 Jan. 13, 2005

(30) Foreign Application Priority Data

Jul. 7, 2003 (TW) ..... 92118522 A

(51) Int. Cl.
*G05F 1/00* (2006.01)
*H05B 41/16* (2006.01)

(52) U.S. Cl. ..... 315/276; 315/308; 315/248

(58) Field of Classification Search ..... 315/244, 315/94, 86, 395, 169.3, 291, 105, 311, 307, 315/219; 363/134, 135, 165, 166, 20, 65, 363/71; 323/283, 284

See application file for complete search history.

(56) References Cited

U.S. PATENT DOCUMENTS

| | | | | |
|---|---|---|---|---|
| 3,869,639 | A * | 3/1975 | Herzog | 315/86 |
| 4,595,861 | A * | 6/1986 | Simopoulos et al. | 315/169.3 |
| 5,453,667 | A * | 9/1995 | Matsuda et al. | 315/248 |
| 5,932,976 | A * | 8/1999 | Maheshwari et al. | 315/291 |
| 6,339,299 | B1 | 1/2002 | Wu et al. | |
| 6,633,287 | B1 * | 10/2003 | Yatabe et al. | 345/211 |

* cited by examiner

*Primary Examiner*—Rajnikant B. Patel
(74) *Attorney, Agent, or Firm*—Winston Hsu

(57) ABSTRACT

An inverter for providing power to a lamp coupled to a power supply and a lamp circuit. The inverter can selectively provide the lamp circuit with AC voltages of two different frequencies. The inverter includes: a first switch for passing a DC voltage; a first and second oscillating circuit coupled to the first switch that receives DC voltage and respectively generates a first AC voltage having a first frequency and a second AC voltage having a second frequency; and a transformer coupled to the first oscillating circuit and the second oscillator for transforming the first AC voltage provided by the first oscillating circuit or the second AC voltage provided by the second oscillator into a third AC voltage and passing the third AC voltage to the lamp circuit. The first switch serves to selectively pass the DC voltage to the first oscillating circuit or the second oscillating circuit.

7 Claims, 4 Drawing Sheets

INVERTER FOR PROVIDING POWER TO LAMP CIRCUIT

BACKGROUND OF INVENTION

1. Field of the Invention

The present invention relates to an inverter and more particularly, to an inverter for providing AC voltages having two different frequencies to a lamp circuit.

2. Description of the Prior Art

A high voltage lamp is a common optical part found in devices used in daily life such as scanners and fax machines and need high voltage lamps for operation. Normally, a high voltage lamp is powered by an inverter. The duties of the inverter are to first transform a DC voltage into an AC voltage and then provide the AC voltage to drive the high voltage lamp. A characteristic of the high voltage lamp is that the power requirement of the high voltage lamp during a starting state differs from a normal luminescent state; usually the power required during the starting state is larger than the power required during the normal luminescent state. If the amount of power used in the normal luminescent state is used in the starting state to start the high voltage lamp, it will take too much time for the lamp to start up; hence, the operation of the high voltage lamp will become inconvenient.

As mentioned above, a high voltage lamp uses AC voltage. Assume that for a lamp circuit (including a high voltage lamp) to operate in normal luminescent state, an operating AC voltage is needed for providing suitable power to the lamp circuit. In order to provide more power to the lamp circuit during the starting state, typically, a starting AC voltage having a larger amplitude than the operating voltage is provided to the lamp circuit (normally the frequency of the operating AC voltage is the same as the frequency of the starting AC voltage). Theoretically, the power an AC voltage can provide is determined by the amplitude of the AC voltage; the larger the amplitude of the AC voltage, the more power the AC voltage can provide. If the amplitude of the starting AC voltage is larger than the amplitude of the operating AC voltage, then the starting AC voltage can provide more power than the operating AC voltage and allow the lamp circuit to achieve the goal of a fast start up.

Please refer to FIG. 1 a block diagram of a prior art inverter is illustrated. A power supply 110 provides a first DC voltage V1 and a second DC voltage V2. An inverter 120 includes a first switch 130, an oscillating circuit 150, and a transformer 170. The function of the first switch 130 is to selectively pass V1 or V2 to the oscillating circuit 150 as input voltage. The oscillating circuit 150 receives a DC voltage and then oscillates to generate an AC voltage having frequency Fq for outputting. The transformer 170 receives the AC voltage provided by the oscillating circuit 150, transforms the AC voltage, and outputs the transformed AC voltage to the lamp circuit 190, which includes a high voltage lamp 195.

No matter if V1 or V2 serves as the input voltage of the oscillating circuit 150, the frequency of the AC voltage generated by the oscillating circuit 150 will be fixed to the same value (the fixed value is determined by the parameters of elements of the oscillating circuit 150). When the transformer 170 receives the AC voltage provided by the oscillating circuit 150, the frequency of the AC voltage will not be changed by the transformer 170, so the frequency of the AC voltage Vac outputted by the transformer 170 is still Fq.

Assume that when the first DC voltage V1 serves as the input voltage of the oscillating circuit 150, the AC voltage Vac outputted by the transformer 170 has an amplitude Vac1; when the second DC voltage V2 serves as the input voltage of the oscillating circuit 150, the AC voltage Vac outputted by the transformer 170 has an amplitude Vac2. Also assume that the AC voltage Vac with amplitude Vac1 and frequency Fq is the AC voltage suitable for the lamp 195 of the lamp circuit 190 to operate at the normal luminescent state. As mentioned before, in order to provide larger power during the starting state, typically, the amplitude Vac2 must be larger than the amplitude Vac1, and the AC voltage with amplitude Vac2 must be used during the starting state to achieve the goal of a fast start up.

To sum up, in the prior art for starting the lamp 195 of the lamp circuit 190, the second DC voltage V2 is used as input voltage of the oscillating circuit 150. To satisfy the requirement that the amplitude Vac2 is larger than the amplitude Vac1, the second DC voltage V2 must be larger than the first DC voltage V1. The operation principle is that during the starting state, the first switch 130 passes the second DC voltage V2 to the oscillating circuit 150 in order to start the lamp 195 quickly; after the starting state is finished (usually when the lamp 195 has reached 80% of its luminosity), the first switch 130 switches to pass the first DC voltage V1 to the oscillating circuit 150 to operate the lamp 195 at the normal luminescent state.

However, the prior art solution suffers from a few problems. The main problem is that when using the AC voltage with larger amplitude to start up the lamp 195, the current flow through the lamp 195 is also larger than normal operating current. Normal operating current has little effect on the lifetime of the lamp 195, but the larger current used during the starting state usually damages the lamp 195 and thereby reducing the lifetime of the lamp 195. For a high voltage lamp that must be turned on and off frequently, the reduction of the lifetime is a serious problem.

In a device such as a scanner, a fax machine, a high voltage lamp is always a critical component. When the high voltage lamp is damaged, the whole device will also lose normal functionality. So the lifetime of the high voltage lamp in such kind of devices is very important. In conclusion, a main problem of the prior art which uses an AC voltage having larger amplitude to start a high voltage lamp than the amplitude of the AC voltage used during a normal operating state, is that the reduction of the lifetime of the high voltage lamp.

SUMMARY OF INVENTION

It is therefore a primary objective of the present invention to provide an inverter having two oscillating circuits for providing two AC voltages, differing in frequency, to a lamp circuit. So during a normal operating state and a starting state, the lamp circuit uses different AC voltages with different frequencies. The problem of the prior art can be solved.

According to the claimed invention, an inverter is provided. The inverter is coupled between a voltage supply and a lamp circuit for providing AC voltages having two different frequencies to the lamp circuit. The inverter includes: a first switch for passing a DC voltage, a first oscillating circuit coupled to the first switch for receiving the DC voltage and generating a first AC voltage having a first frequency, a second oscillating circuit coupled to the first switch for receiving the DC voltage and generating a second AC voltage having a second frequency, and a transformer coupled to the first oscillating circuit and the second oscillator for transforming the first AC voltage provided by the first oscillating circuit or the second AC voltage provided by the second oscillator into a third AC voltage and passing the third AC voltage to the lamp circuit.

It is an advantage of the claimed invention that the inverter can provide the lamp circuit with AC voltages of two different frequencies. During the normal luminescent state, the AC voltage with the lower frequency can be used in the lamp circuit; during the starting state, the AC voltage with the higher frequency can be used in the lamp circuit to start up the lamp without damaging the lamp.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
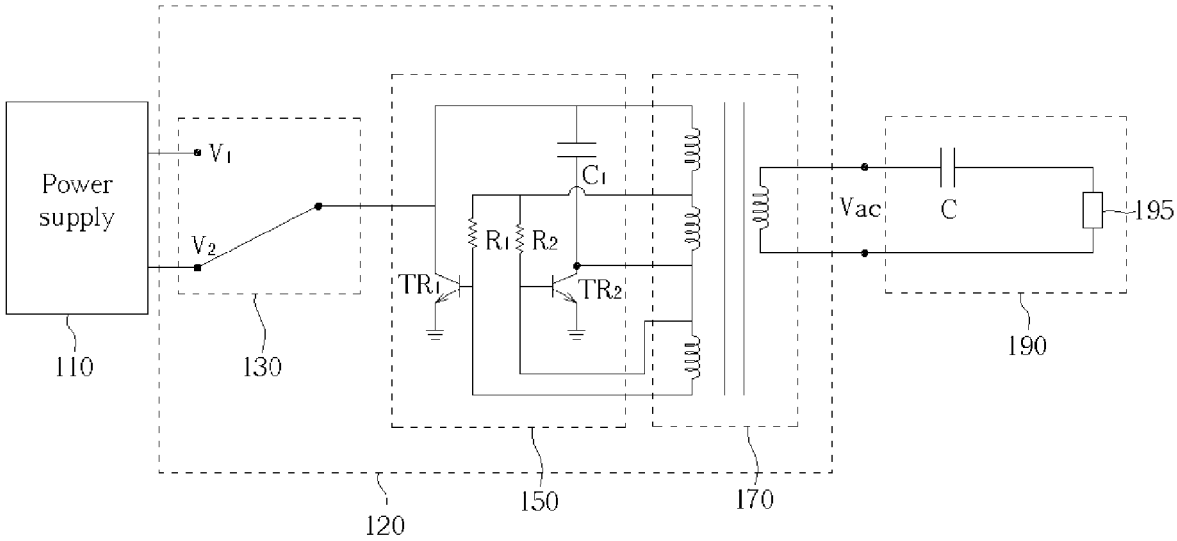
Fig. 1 Prior Art
FIG. 1 is a block diagram of a prior art inverter.
Figure 2:
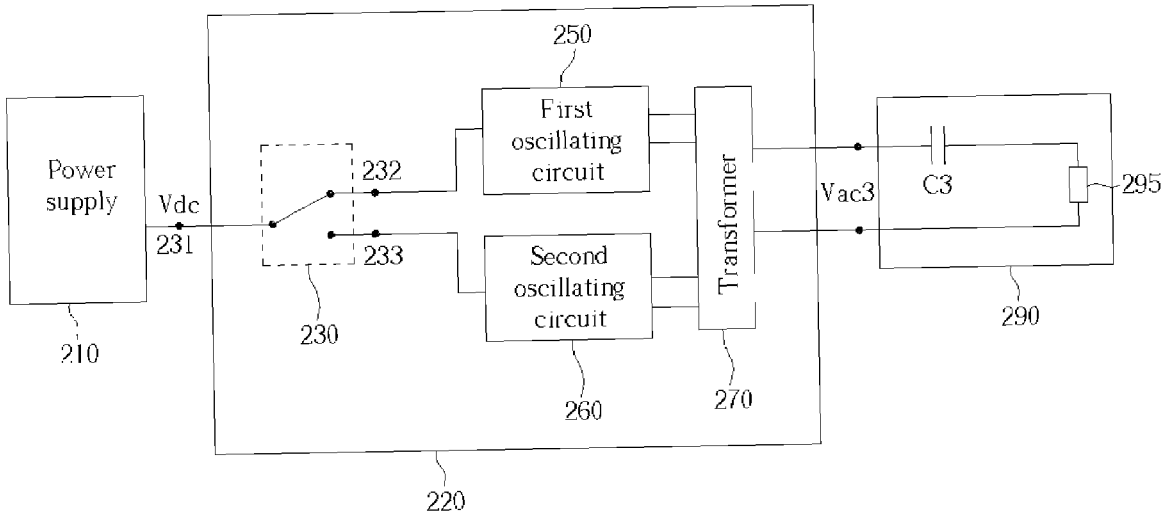
FIG. 2 is an embodiment block diagram of the present invention.

Please refer to FIG. 2 where an embodiment block diagram of the present invention is illustrated. In FIG. 2, an inverter 220 is coupled between a power supply 210 and a lamp circuit 290. The inverter 220 is capable of providing AC voltages of two different frequencies to the lamp circuit 290. The inverter 220 includes a first switch 230, a first oscillating circuit 250, a second oscillating circuit 260, and a transformer 270.

The first switch 230 is coupled to the power supply 210 for receiving a DC voltage Vdc provided by the power supply 210 from a power-input node 231. The function of the first switch 230 is to selectively pass the DC voltage Vdc from the power-input node 231 to either the first oscillating circuit 250 or the second oscillating circuit 260. The first oscillating circuit 250 is coupled to the first switch 230 through a node 232. When the first switch 230 passes the DC voltage Vdc from the power-input node 231 to the node 232, the first oscillating circuit 250 receives the DC voltage Vdc and then generates a first AC voltage having a first frequency Fq1. The second oscillating circuit 260 is coupled to the first switch 230 through a node 233. When the first switch 230 passes the DC voltage Vdc from the power-input node 231 to the node 233, the second oscillating circuit 260 receives the DC voltage Vdc and then generates a second AC voltage having a second frequency Fq2.

The transformer 270 is coupled to the first oscillating circuit 250, the second oscillating circuit 260, and the lamp circuit 290. The functions of the transformer 270 is to transform the first AC voltage provided by the first oscillating circuit 250 or the second AC voltage provided by the second oscillating circuit 260 into a third AC voltage Vac3 and then pass the third AC voltage Vac3 to the lamp circuit 290 for the lamp 295 to utilize.

Because the transformer 270 does not change the frequency of the AC voltage, the frequency of the third AC voltage Vac3 is mainly determined by the first oscillating circuit 250 or the second oscillating circuit 260. When the switch 231 passes the DC voltage Vdc from the power-input node 231 to the first oscillating circuit 250, the frequency of the third AC voltage Vac3 will be the same as the frequency of the first AC voltage outputted by the first oscillating circuit 250, that is, the first frequency Fq1. Assume that at this time the third AC voltage Vac3 has a first amplitude Vam1. When the switch 231 passes the DC voltage Vdc from the power-input node 231 to the second oscillating circuit 260, the frequency of the third AC voltage Vac will be the same as the frequency of the second AC voltage outputted by the second oscillating circuit 260, that is, the second frequency Fq2. Assume that at this time the third AC voltage has a second amplitude Vam2.

As shown in FIG. 2, in addition to the lamp 295, the lamp circuit 290 further includes an equivalent capacitor C3. The capacitor C3 has a first impedance Z1 and the lamp 295 has a second impedance Z2. If the power provided by the third AC voltage Vac3 is W1, the lamp 295 will not get all the power W1. The power the lamp 295 will get is W1×cos θ; the remaining power W1×sin θ will be consumed by the capacitor C3. The term cos θ is referred to as a power factor of the lamp 295. The value of the power factor cos θ will be as follows:

$$\cos\theta = \frac{|Z2|}{\sqrt{Z1^2 + Z2^2}}$$

The bigger the power factor cos, the more power the lamp 295 can get from the third AC voltage Vac3.

It is obvious that the first impedance Z1 of the capacitor C3 is:

$$Z1 = \frac{1}{2\pi \cdot f \cdot C}.$$

Wherein f is the frequency of the third AC voltage Vac3 and C is the capacitance of the capacitor C3. The larger the frequency f of the third AC voltage Vac3 has, the smaller the first impedance Z1 will be, and the bigger the power factor cos θ will be. As a result, the lamp 295 can get more power from the third AC voltage Vac3.

Hence if the second frequency Fq2 is larger than the first frequency Fq1 (with the assumption the second amplitude Vam2 is not smaller than the first amplitude Vam1), the third AC voltage Vca3 with the second frequency Fq2 can provide more power to the lamp 295 than the third AC voltage Vca3 with the first frequency Fq1 can provide. If the third AC voltage Vca3 with the second frequency Fq2 is passed to the lamp circuit 290, the lamp 295 can get more power, so the starting process will be completed very fast.

In this embodiment, the parameters of the elements in the first oscillating circuit 250 and the second oscillating circuit 260 must be designed properly in order to make the second frequency Fq2 of the second AC voltage generated by the second oscillating circuit 260 to have a larger value than the first frequency Fq1 of the first AC voltage generated by the first oscillating circuit 250. During the starting state of the lamp 295, the switch 230 passes the DC voltage Vdc from the power-input node 231 to the second oscillating circuit 260; after the lamp 295 enters the normal luminescent state, the switch 230 switches to pass the DC voltage Vdc from the power-input node 231 to the first oscillating circuit 250. The lamp 295 can get larger amount of power during the starting state, so the starting process will be completed quickly.

Figure 3:
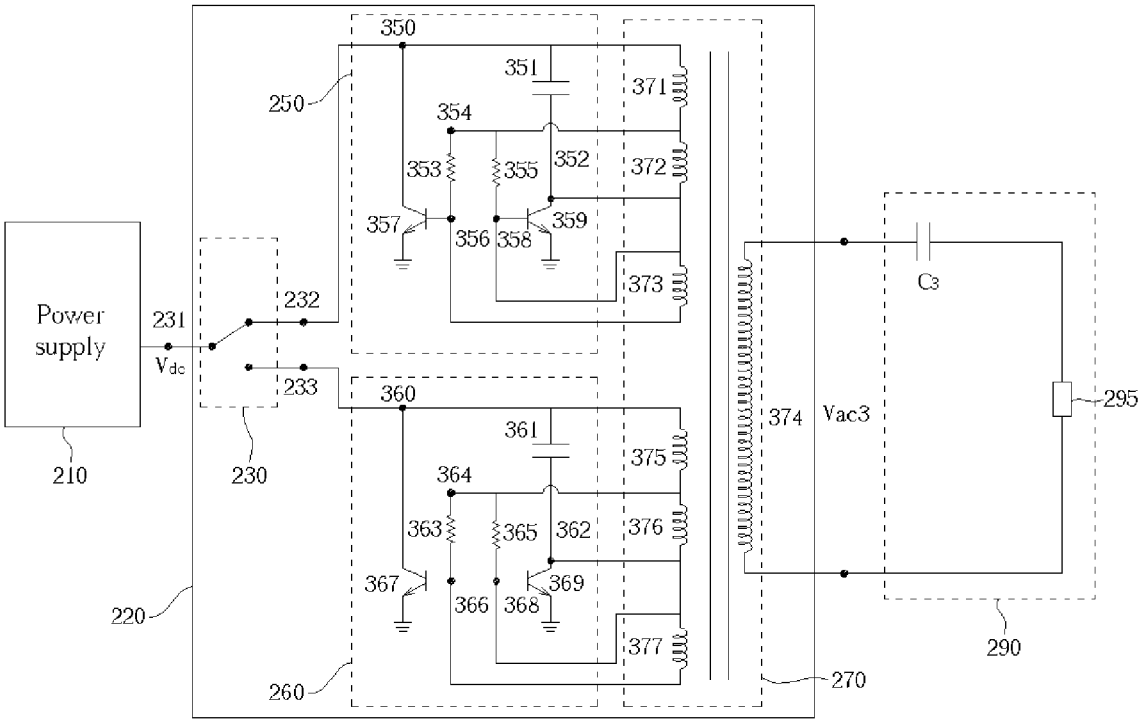
FIG. 3 is an embodiment circuit diagram of the inverter 220 of FIG. 2.

Please refer to FIG. 3 where an embodiment circuit diagram of the inverter 220 is illustrated. In this embodiment the first oscillating circuit 250 includes: a first capacitor 351 coupled between a first node 350 and a second node 352; a first resistor 353 coupled between a third node 354 and a fourth node 356; a second resistor 355 coupled between the third node 354 and a fifth node 358; a first transistor 357 having a first end coupled to the first node 350, a second end coupled to the fourth node 356, and a third end coupled to ground; and a second transistor 359 having a first end coupled to the second node 352, a second end coupled to the fifth node 358, and a third end coupled to ground.

The second oscillating circuit 260 includes: a second capacitor 361 coupled between a sixth node 360 and a seventh node 362; a third resistor 363 coupled between an eighth node 364 and a ninth node 366; a fourth resistor 365 coupled between the eighth node 364 and a tenth node 368; a third transistor 367 having a first end coupled to the sixth node 360, a second end coupled to the ninth node 366, and a third end coupled to ground; and a fourth transistor 369 having a first end coupled to the seventh node 362, a second end coupled to the tenth node 368, and a third end coupled to ground.

As mentioned before, in this embodiment the parameters of the elements in the first oscillating circuit 250 and the second oscillating circuit 260 must be properly arranged so that the second frequency Fq2 of the second AC voltage generated by the second oscillating circuit 260 is larger than the first frequency Fq1 of the first AC voltage generated by the first oscillating circuit 250. Please notice that the circuit diagram shown in FIG. 3 only serves as an example; in reality the elements of the first oscillating circuit 250 and the second oscillating circuit 260 do not necessarily have to be exactly the same as what is shown in FIG. 3. The real circuit design is left to the circuit designer as a design choice.

Also in this embodiment is the transformer 270 which includes: a first coil 371 coupled between the first node 350 and the third node 354; a second coil 372 coupled between the third node 354 and the second node 352; a third coil 373 coupled between the fifth node 358 and the fourth node 356; a fourth coil 375 coupled between the sixth node 360 and the eighth node 364; a fifth coil 376 coupled between the eighth node 364 and the seventh node 362; a sixth coil 377 coupled between the tenth node 368 and the ninth node 366; and a seventh coil 374 coupled between a first end and a second end of the lamp circuit.

With the transformer 270 depicted above, the first AC voltage generated by the first oscillating circuit 250 or the second AC voltage generated the second oscillating circuit 260 will be transformed to become the third AC voltage Vac3 and then passed to the lamp circuit 290.

Figure 4:
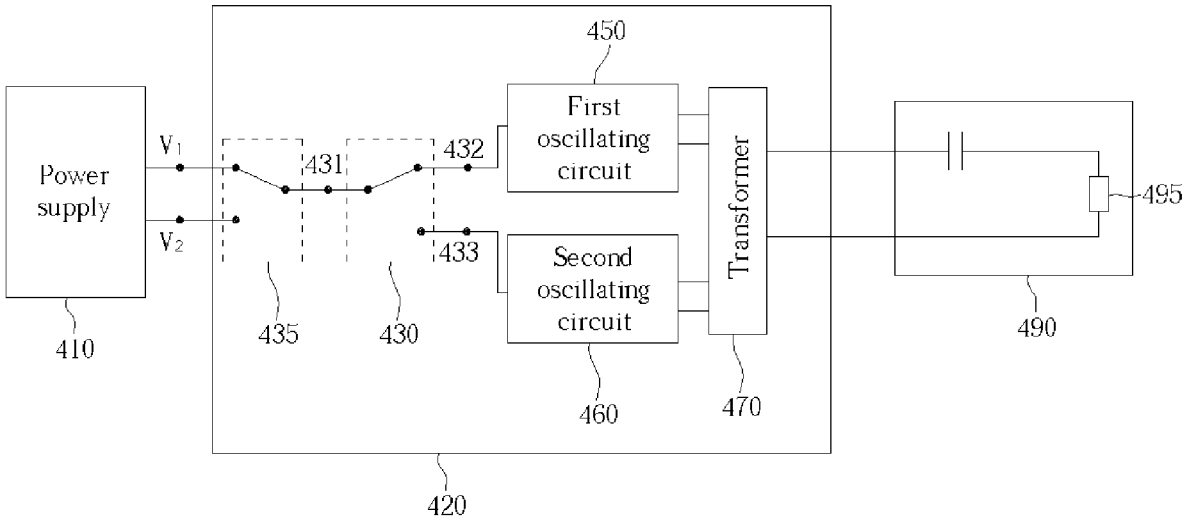
FIG. 4 is an alternative embodiment block diagram of the present invention.

In addition, the present invention of the inverter can further use different DC voltages with different values as power source. Please refer to FIG. 4 where an alternative embodiment block diagram of the present invention is illustrated. Different from FIG. 2, in FIG. 4 a power supply 410 can provide an inverter 420 with two DC voltages of different values. The inverter 420 further includes a second switch 435, coupled between the power supply 410 and a power-in node 431, for selectively passing a first DC voltage V1 or a second DC voltage V2 provided by the power supply 410 to the power-in node 431. The switch 435 and the switch 430 work together to decide whether the first DC voltage V1 or the second DC voltage V2 will be passed to the node 432 for a first oscillating circuit 450 to utilize, or to the node 433 for a second oscillating circuit 460 to utilize. Please notice that in actuality, the power supply 410 can provide more than two DC voltages to the inverter 420, and the switch 435 can have more than two switching states for increased controlling ability on the lamp circuit 490.

The inverters discussed above can be used in a scanner, a fax machine, or a multi-function peripheral to provide AC voltages to a lamp in that device.

In contrast to the prior art, the present inverter can provide AC voltages with two different frequencies to a lamp circuit having a lamp. Because the system uses an AC voltage with a higher frequency rather than a larger amplitude to start up the lamp, the lamp will not be damaged, and the lifetime of the lamp will not be shortened.

Those skilled in the art will readily observe that numerous modification and alternation of the device may be made while retaining the teaching of the invention. Accordingly, the above disclosure should be construed as limited only by the metes and bounds of the appended claims.

What is claimed is:

1. An inverter for providing AC voltages having two different frequencies to a lamp circuit, the inverter comprising:

a first switch for passing a DC voltage;

a first oscillating circuit coupled to the first switch for receiving the DC voltage and generating a first AC voltage having a first frequency;

a second oscillating circuit coupled to the first switch for receiving the DC voltage and generating a second AC voltage having a second frequency;

a second switch coupled between a power supply and the first switch for passing the first DC voltage or a second DC voltage provided by the power supply to the first switch as the DC voltage; and a transformer coupled to the first oscillating circuit and the second oscillator for transforming the first AC voltage provided by the first oscillating circuit or the second AC voltage provided by the second oscillator into a third AC voltage and passing the third AC voltage to the lamp circuit;

wherein the first switch selectively passes the DC voltage to the first oscillating circuit or the second oscillating circuit.

2. The inverter of claim 1, wherein the first switch is coupled to the power supply for receiving the DC voltage provided by the power supply.

3. The inverter of claim 1, wherein the first oscillating circuit comprises:

a first capacitor coupled between a first node and a second node;

a first resistor coupled between a third node and a fourth node;

a second resistor coupled between the third node and a fifth node;

a first transistor having a first end coupled to the first node, a second end coupled to the fourth node, and a third end coupled to ground; and a second transistor having a first end coupled to the second node, a second end coupled to the fifth node, and a third end coupled to ground.

4. The inverter of claim 3, wherein the transformer comprises:

a first coil coupled between the first node and the third node;

a second coil coupled between the third node and the second node;

a third coil coupled between the fifth node and the fourth node; and a seventh coil coupled between a first end and a second end of the lamp circuit.

5. The inverter of claim 1, wherein the second oscillating circuit comprises:

a second capacitor coupled between a sixth node and a seventh node;

a third resistor coupled between an eighth node and a ninth node;

a fourth resistor coupled between the eighth node and a tenth node;

a third transistor having a first end coupled to the sixth node, a second end coupled to the ninth node, and a third end coupled to ground; and a fourth transistor having a first end coupled to the seventh node, a second end coupled to the tenth node, and a third end coupled to ground.

6. The inverter of claim 5, wherein the transformer comprises:

a fourth coil coupled between the sixth node and the eighth node;

a fifth coil coupled between the eighth node and the seventh node;

a sixth coil coupled between the tenth node and the ninth node; and a seventh coil coupled between a first end and a second end of the lamp circuit.

7. The inverter of claim 1, wherein the inverter is used in a scanner, a multi-function peripheral, or a fax machine.

* * * * *